US005695278A

United States Patent [19]

Grossman et al.

[11] Patent Number: 5,695,278

[45] Date of Patent: Dec. 9, 1997

[54] WORKLIGHT FIXTURE WITH SAFETY HANDLES AND INTEGRAL STORAGE COMPARTMENT FOR ADDITIONAL BULB

[75] Inventors: M. Gary Grossman, Riverside, Conn.; Edward H. Meisner, Short Hills, N.J.; Michael P. Ballone, New Providence, N.J.; John E. Kiely, Morristown, N.J.

[73] Assignee: Regent Lighting Corporation, Burlington, N.C.

[21] Appl. No.: 764,234

[22] Filed: Dec. 14, 1996

[51] Int. Cl.[6] ..... F21S 1/12

[52] U.S. Cl. ..... 362/374; 362/375; 362/376; 362/399

[58] Field of Search ..... 362/374, 375, 362/399, 376, 400, 455, 310, 410, 184

[56] References Cited

U.S. PATENT DOCUMENTS

| | | | |
|---|---|---|---|
| 5,243,507 | 9/1993 | Atkins et al. | 362/376 |
| 5,455,756 | 10/1995 | Sumer et al. | 362/376 |
| 5,493,484 | 2/1996 | Osteen et al. | 362/399 |

*Primary Examiner*—Thomas M. Sember
*Attorney, Agent, or Firm*—Niro, Scavone, Haller & Niro

[57] ABSTRACT

A portable halogen bulb worklight fixture is formed with a housing forming a bulb containing cavity and a light emitting opening. A peripheral frame, a frame handle extending outwardly from one side of the frame. A top handle is located above the frame and a bulb storage compartment is located in the top handle. A base structure is arranged to minimize exposure of the user to heat generated by the fixture when replacing a bulb and when being transported from one site to another.

4 Claims, 6 Drawing Sheets

WORKLIGHT FIXTURE WITH SAFETY HANDLES AND INTEGRAL STORAGE COMPARTMENT FOR ADDITIONAL BULB

BACKGROUND OF THE INVENTION

1. Field of the Invention

The invention relates to a portable worklight fixture incorporating handles located and shaped for avoiding exposure to excessive heat produced by its halogen or quartz type bulb and having a housing with a front face and a front opening through which light is emitted. More particularly, the invention relates to a portable halogen worklight fixture having a safety handle attached to the fixture's peripheral frame which in turn is hingedly attached to the housing, and to a top safety handle for storage of a spare halogen bulb.

2. Description of the Related Art

A typical portable halogen worklight fixture has a housing and within the housing a halogen bulb that emits light through the housing's front light emitting opening. Substantial heat is also generated by the bulb. A grill is positioned in front of the light emitting opening so as to protect the user from getting burned. Exterior protruding ridges are also typically formed on the exterior of the fixture housing to increase the surface area of the housing for release of heat. Operation of the fixture, however, may still result in a hot grill and fixture housing, which can, if touched, cause substantial discomfort.

A traditional portable halogen worklight fixture of the type described has a transport handle attached directly to its housing. The transport handle's grabbing portion is located above the housing and opposite the housing support base attached to and located below the bottom of the housing. This traditional handle arrangement has several disadvantages. For ease, a user normally transports the fixture by the top handle at arms length adjacent one of the user's legs. During transport, the fixture is likely to bear against or be substantially close to the user's leg causing substantial discomfort if not burning. A second disadvantage is that the traditional worklight fixture's height, measured from its top handle to the support base, is relatively long, causing the fixture to extend substantially down along the user's leg, making the fixture unbalanced and clumsy to carry. A third disadvantage is related to replacing the fixture's halogen bulb. A user is likely to want to replace an expended bulb quickly. The typical worklight fixture requires a user to directly manipulate the potentially hot grill and housing when replacing the halogen bulb.

A typical example of a portable halogen worklight fixture of the type referred to above is disclosed in U.S. Pat. No. 5,408,399 (the "'399 patent"). The '399 patent discloses a handle located above a portable worklight fixture housing, and further discloses a peripheral frame which, in its closed position, surrounds the housing light emitting opening. A series of clips overlie the safety guard and lens to press the guard and lens into an assembled relationship with a peripheral frame. To remove or open the grill and lens relative to the housing, a user must remove the clips and carry the grill and frame away from their housing. When reattaching the frame and grill to the housing, the user must again directly handle the grill and/or frame.

Another example of a portable halogen worklight fixture is disclosed in U.S. Pat. No. 4,344,756 (the "'756 patent"). The '756 patent also discloses a handle located above a portable light fixture housing, and a grate and lens mounted on a peripheral frame which in turn pivots on the bottom of the fixture's housing and is secured by a wingnut. To open the frame relative to the fixture's housing, the user must unscrew a wingnut holding the frame and handle to the housing, and once unscrewed, pivot the frame to an open position. To fully open the frame the user has the option of letting it fall freely, or directly holding the frame. After replacing the bulb, the user must hold the frame and/or grill to press it closed against the housing and then secure the wingnut.

It would therefore be beneficial as recognized by the present invention to have a worklight fixture with a handle located and shaped such that it improves the safety of the worklight fixture during both transport and halogen bulb replacement. The invention also recognizes that it would also be beneficial to have a worklight fixture with a handle located such that it improves the balance of the worklight fixture during its transport. Of additional benefit would be to include a spare bulb storage compartment on the worklight fixture itself. Typical worklights do not include a storage compartment containing an extra bulb. If the bulb fails, the user's work or project is typically interrupted until a replacement bulb is obtained and replaced.

The object of the invention is thus to provide a portable halogen worklight fixture having all the desired features referred to above. Other aspects will become apparent as the description proceeds.

SUMMARY OF THE INVENTION

A portable halogen worklight fixture according to the invention comprises a housing with a light emitting front opening, a lens and grill mounted to a peripheral frame hingedly attached to the housing and having an open and closed position relative to the housing. A safety handle is attached directly to the peripheral frame, preferably along one vertical side of the peripheral frame. In the preferred embodiment, the frame handle has first and second ends attached to the frame and forms a closed carrying loop therewith. Various advantages arise. The frame handle does not get hot during extended operation of the fixture. The frame handle allows a user to normally transport the fixture such that the fixture's support base is caused to act as a heat buffer and be located between the user and the fixture's potentially hot grill and housing portions. The frame handle also makes transporting the fixture easier because of improved balance. The frame handle is, as already stated, attached to the frame which enables the handle to be grasped to open and close the frame for safe and quick replacement of the fixture's halogen bulb. Thus, unlike the prior art fixture the bulb can be replaced without requiring the user to contact the frame or the grill. The present invention also provides a top hollow handle having a spare-bulb storage compartment therein which provides a quick solution to interruption of work or project due to bulb failure as well as an alternative means for transporting the fixture.

DETAILED DESCRIPTION OF THE INVENTION AND PREFERRED EMBODIMENTS THEREOF

Figure 1:
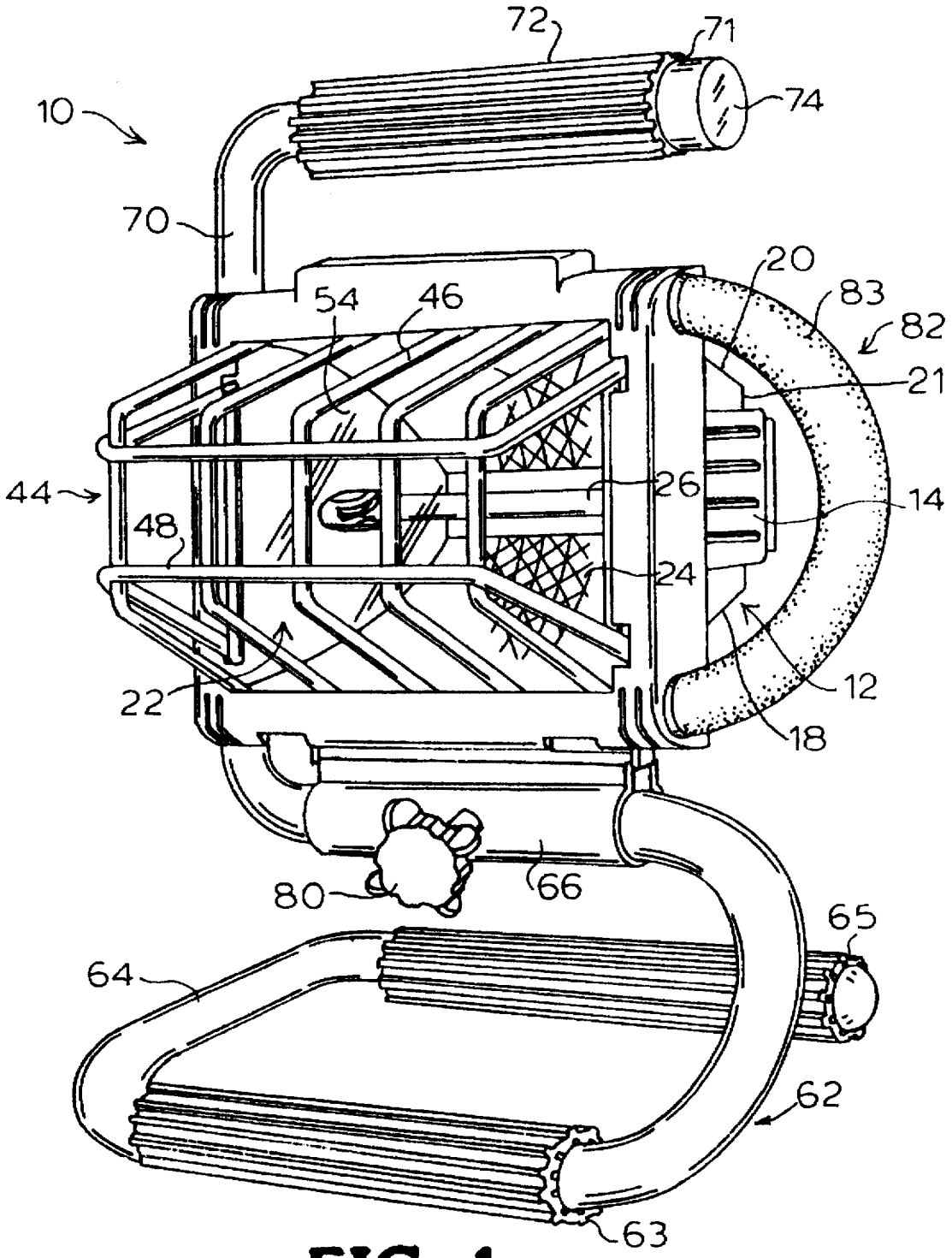
FIG. 1 is a perspective view showing a portable halogen work fixture according to our invention.
Figure 3:
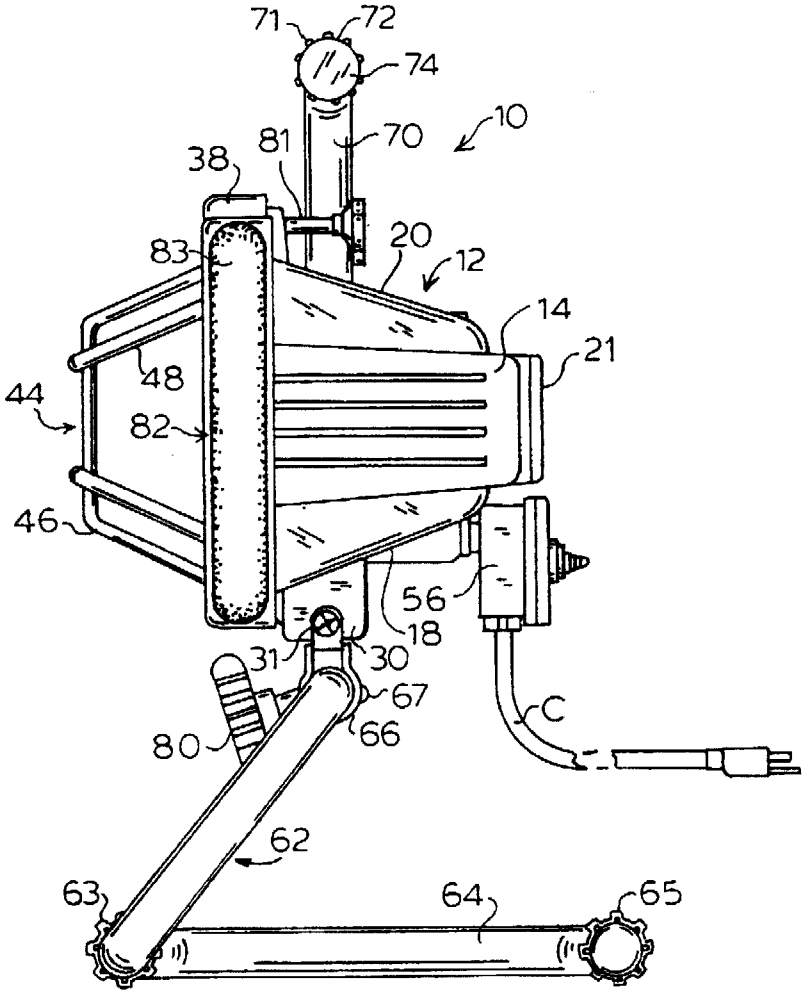
FIG. 3 is a right elevation view thereof.
Figure 4:
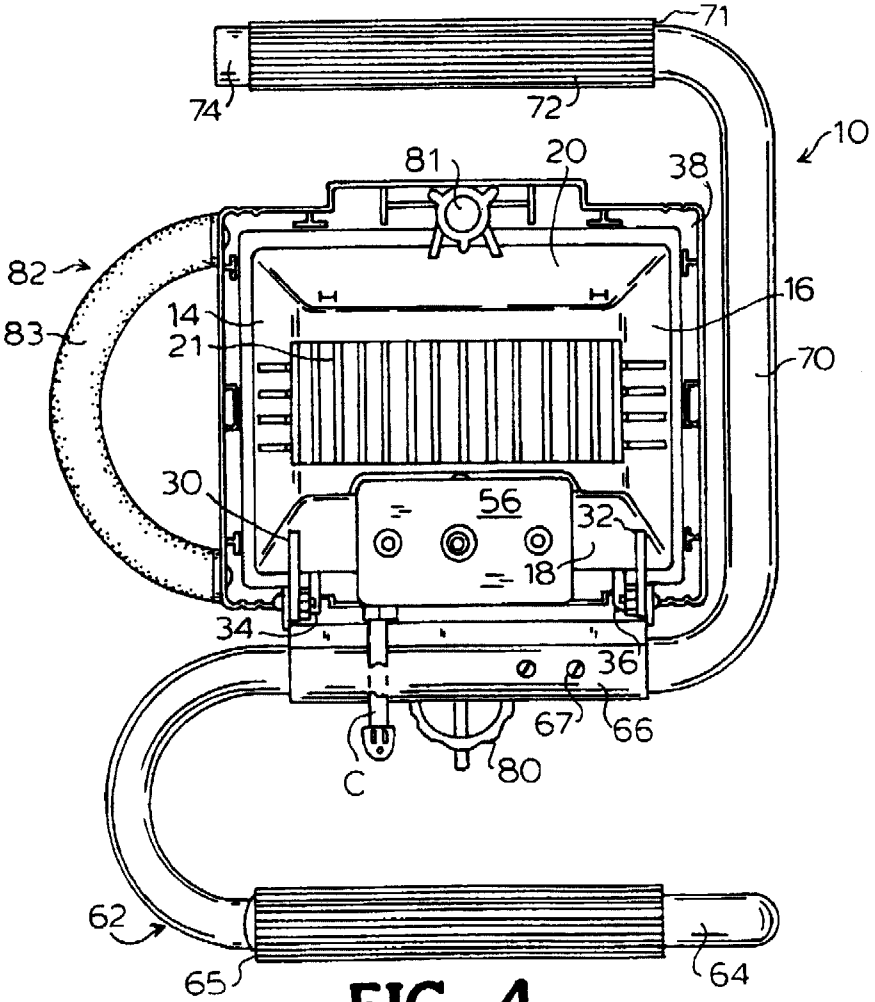
FIG. 4 is a back elevation view thereof.
Figure 6:
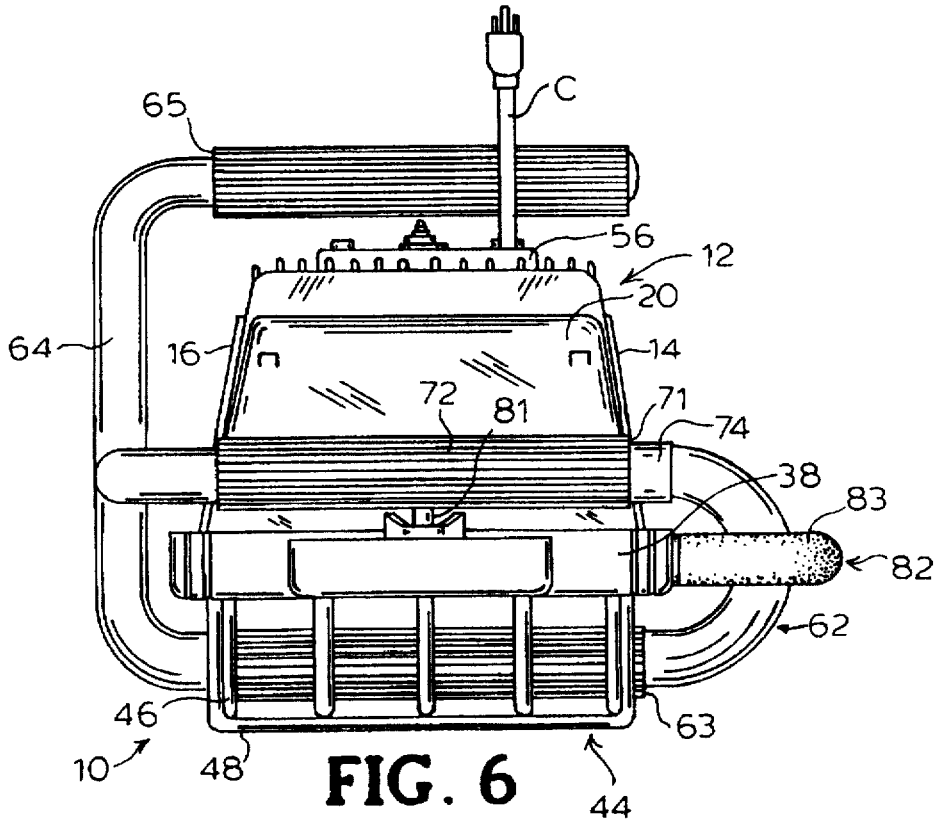
FIG. 6 is a top plan view thereof.

Referring to FIGS. 1 and 3 the portable halogen worklight fixture 10 comprises a housing 12 in which a halogen bulb 26 is located. Housing 12 is substantially rectangular having spaced apart side walls 14, 16, bottom and top walls 18, 20 and back wall 21 (See FIGS. 3 and 4), forming an inner housing cavity and a front light emitting opening 22. Located within housing 12 and adjacent walls is reflector 24 which reflects light emanating from the halogen bulb 26 through light emitting opening 22.

Figure 2:
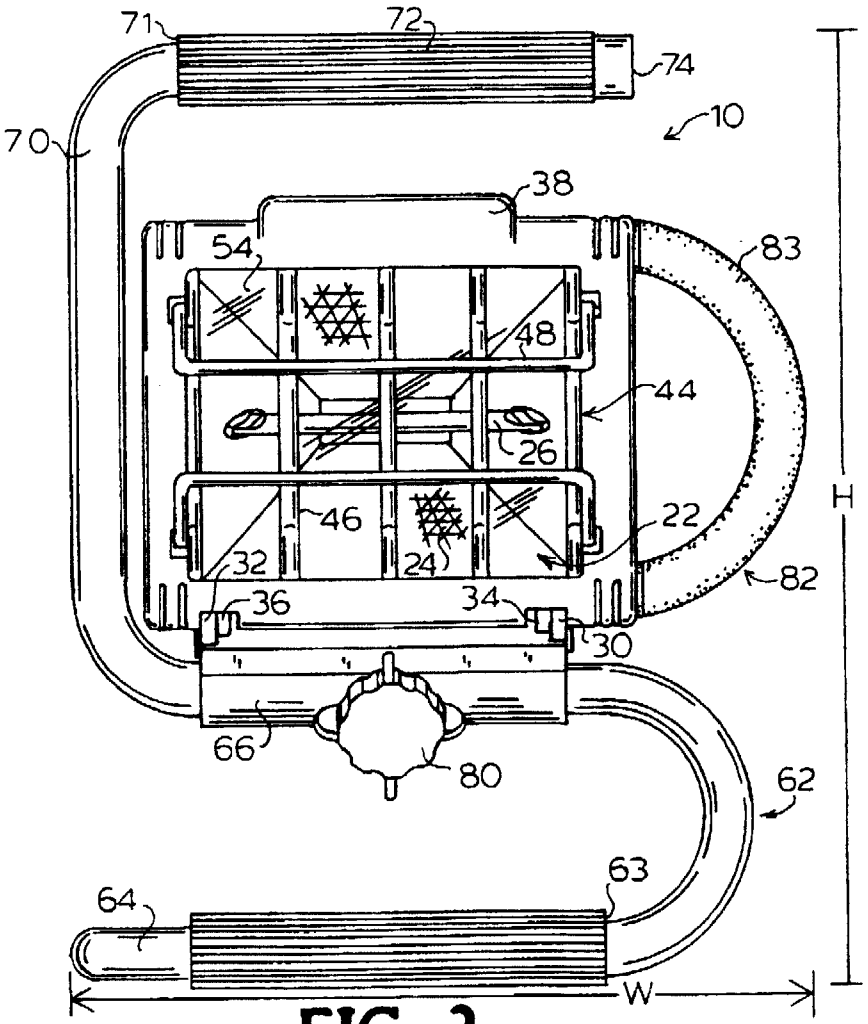
FIG. 2 is a front elevation view of the fixture.
Figure 5:
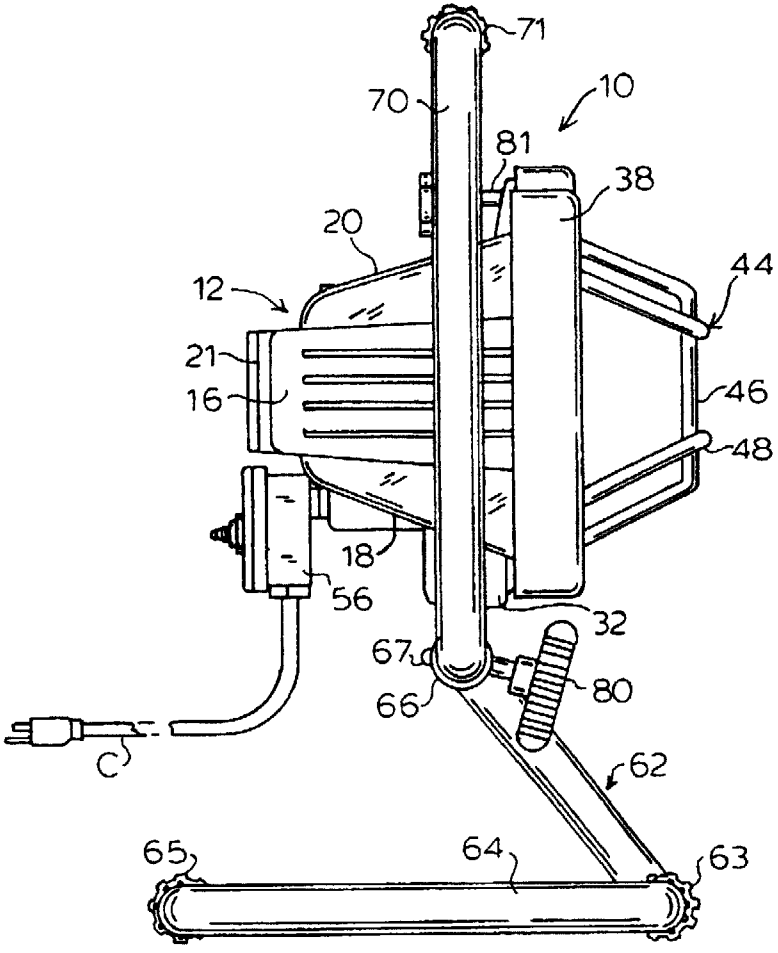
FIG. 5 is left elevation view thereof.
Figure 9:
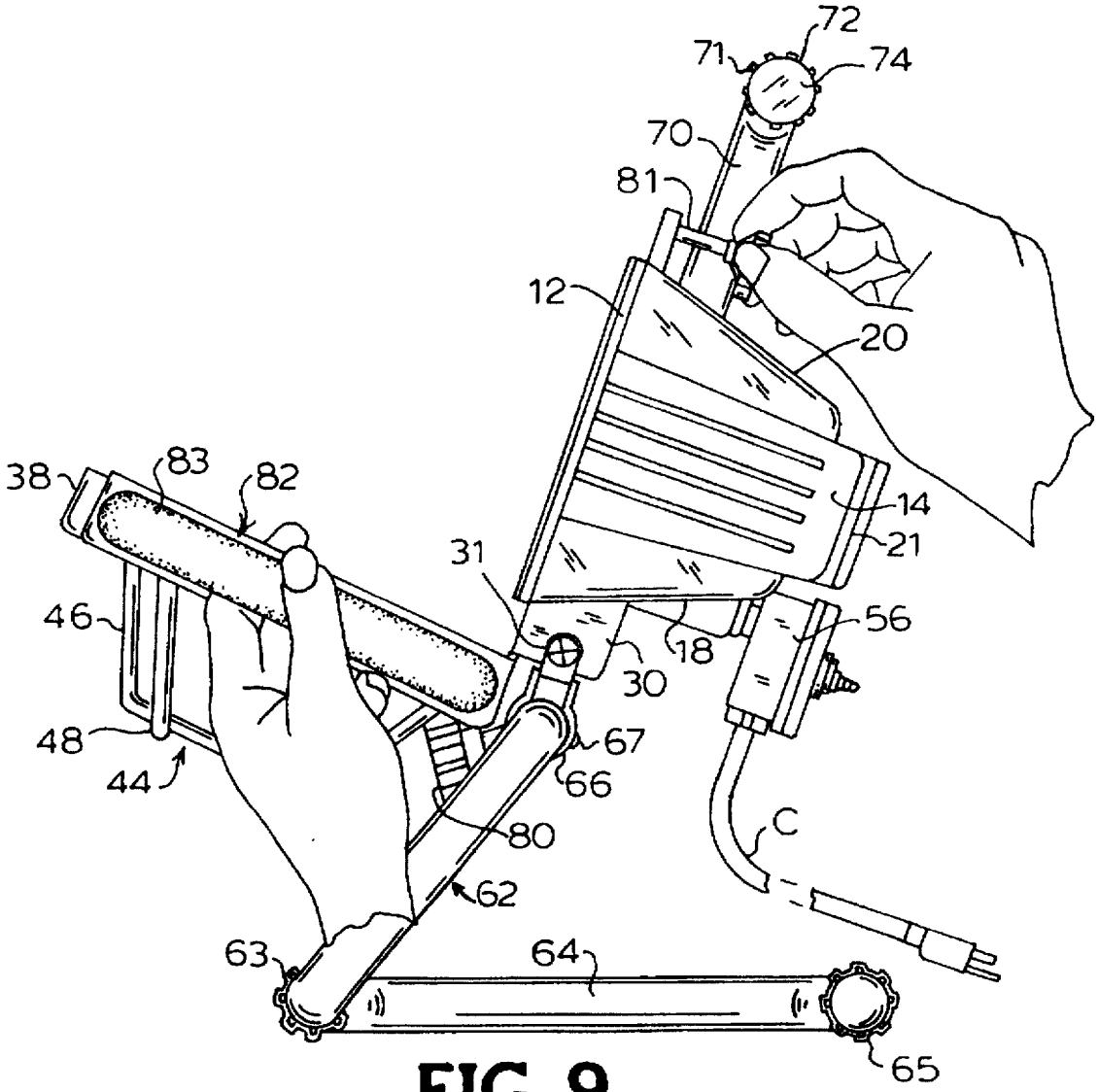
FIG. 9 is an elevation view similar to FIG. 3 and illustrating use of the frame handle to tilt the frame.

Housing flanges 30, 32 formed from wall 18 extend downwardly therefrom. Flanges 34, 36 formed from peripheral frame 38 having spaced-apart substantially rectangular shaped horizontal and vertical sides are positioned so as to provide a pivotal couple with housing flanges 30, 32 (see FIGS. 2 and 4). Peripheral frame 38, when in its closed position relative to housing 12, surrounds light emitting opening 22. Grill 44 is comprised of vertically and horizontally approximately U-shaped spaced wires 46, 48, as viewed from either side of the housing and above or below the housing respectively. Cross bars (not shown) span the inwardly located ends of wires 46, 48 so as to reinforce grill 44. The cross bars extend parallel to respective upper and lower edges of peripheral frame 38 and are rigidly mounted thereto. Lens 54 is also mounted to peripheral frame 38 and is positioned between grill 44 and housing 12. Grill 44 and lens 54 are located in front of light emitting opening 22 when frame 38 is in its closed position as for example in FIGS. 1, 2 and 3. Frame 38 may be hinged to its open position relative to said housing so that a user can gain access to the interior of housing 12 to replace bulb 26 as shown in FIG. 9.

Power is supplied to halogen bulb 26 through an insulated cord C (FIG. 3) that enters a switch box 56. Halogen bulb 26 is in tun connected to the output side of a switch (not shown) located in switch box 56.

Figure 8:
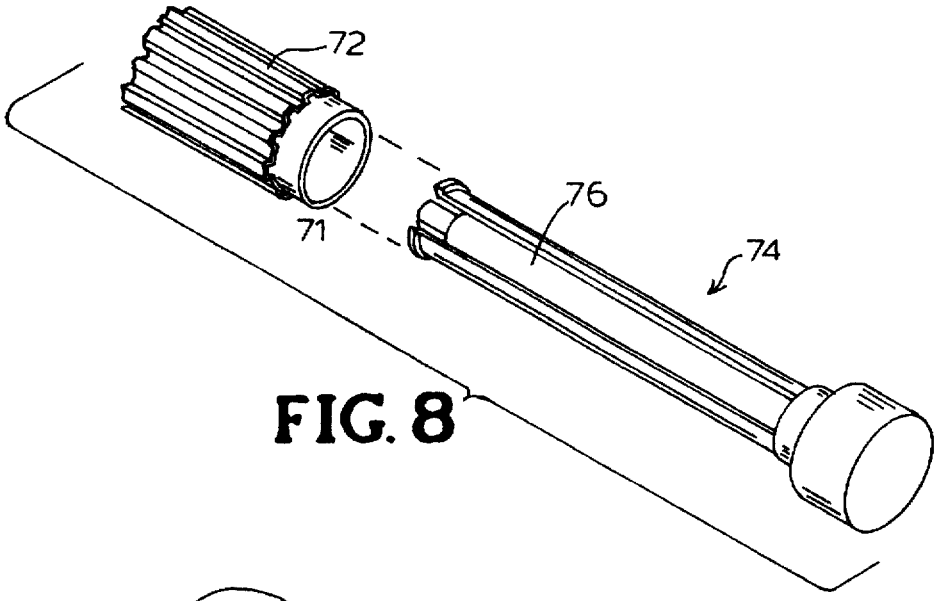
FIG. 8 is a partial exploded view of the top handle.

An elongate tubular support base 62 has a lower support portion 64 that rests flat on a support surface and an upper end portion (not shown) located within hollow tubular support brace 66. Skid resistant covers 63, 65 made from rubber, foam, or plastic material surround parallel portions of lower support portion 64 and are securely attached thereto to prevent the fixture from inadvertently sliding on or marring a support surface. Support brace 66 is attached to flanges 30, 32 on housing 38. Arm 70 has an upper end hollow handle portion 72 and a lower end portion (not shown) located within support brace 66 adjacent upper end portion of base 62 and is secured to support brace 66 by screws 67. Grip 71 made of rubber or like moldable material, surrounds handle portion 72 and is securely attached thereto. Grip 71 minimizes slipping of the user's hold on handle 72. A bulb carrying sleeve 74 with spare bulb 76 therein is stored and held by a resilient fit within the end hollow handle portion 72 and is easily removable therefrom as best seen in FIG. 8.

Figure 7:
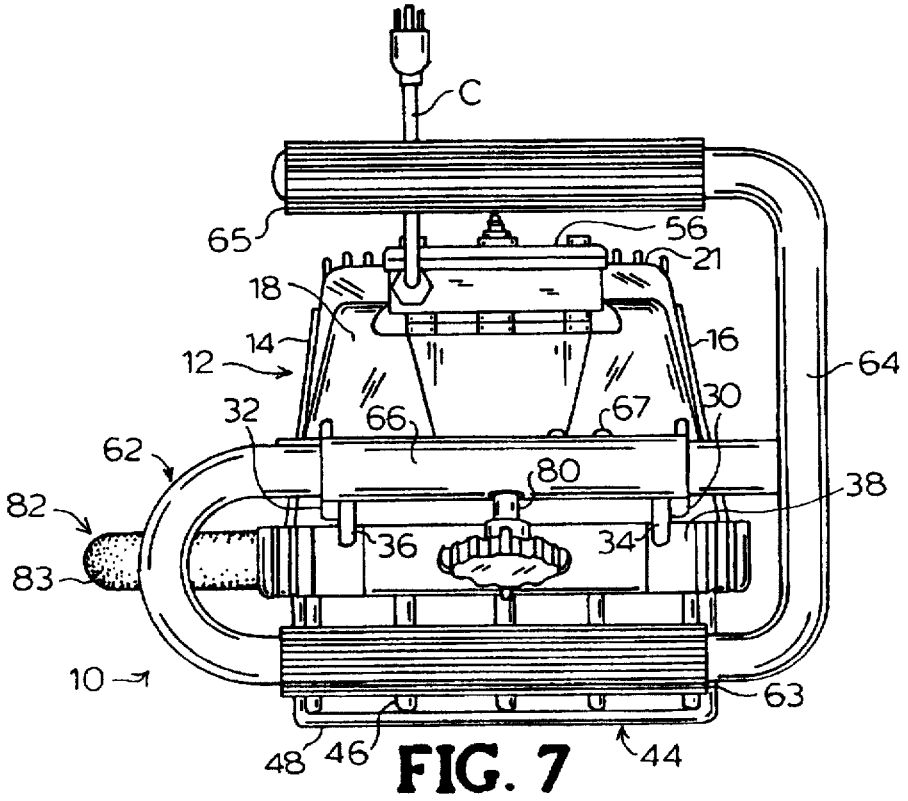
FIG. 7 is a bottom plan view thereof.

An internally threaded hole (not shown) extends through support brace 66. A headed screw 80 extends through the hole (see FIGS. 1 and 7). Loosening of screw 80 enables support brace 66 and attached housing 12 to be rotated around support base 62 upper end, such that housing 12 can be adjusted to direct light to a selected work surface. Screw 80 is tightened to clamp brace 66 and housing 12 in a selected position. Adjustment can also be made by rotating fixture 10 around snugly fitted mounting screws 31 (FIG. 3).

U-shaped frame handle 82 has a first end and a second end fixedly attached to a vertical side of frame 38 thereby forming a closed looped handle therewith. Frame handle cover 83 made of a foam or other suitable insulating material surrounds handle 82, is securely attached thereto, and serves to insulate the user from any heat retained in handle 83. This arrangement eliminates the need for the user to transport the worklight fixture by its top handle at arms length adjacent to one of the user's leg as with the prior art fixture. Instead, with the present invention, the user can use the new U-shaped frame handle 82 to grasp and transport fixture 10 as in FIG. 10 so that base 62 is located adjacent and between the carrier's body and the hot grill 44 and housing 12, thereby acting as a heat buffer. This handle arrangement significantly reduces the discomfort associated with normally transporting a hot fixture.

Figure 10:
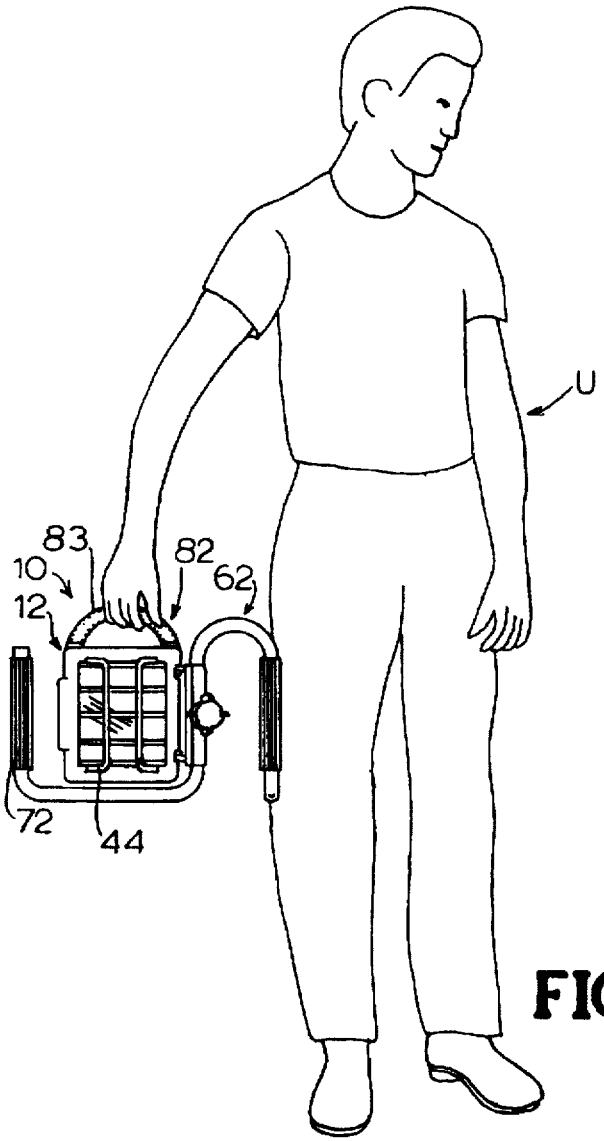
FIG. 10 is an elevation view of a user holding the fixture frame handle in a typical transport position.

Frame handle 82 also improves the balance of fixture 10 during its transport as in FIG. 10. It is well known that the further away an object is from the point at which it is being carried, the more difficult it is to carry. The converse is also true, the closer an object is to the point at which it is being supported, the easier it is to carry. The present invention takes advantage of this principle. Width W (FIG. 2) of fixture 10, defined as the distance between the outer extremity of frame handle 82 and the outer extremity of the vertical portion of arm 70, is shorter than height H of fixture 10, defined as the distance between the uppermost extremity of top handle 72 and the lowermost surface of cover (53. Thus, when a typical worklight fixture 10 is carded by new frame handle 82, the balance and ease of transporting such fixture is improved.

Frame handle 82 also makes it easier and safer for a user to replace a burned-out halogen bulb. Traditionally, to replace a bulb, the user must open or remove the peripheral frame, replace the spare bulb, and then close the peripheral frame relative to the housing. In this procedure a user is normally required to hold the frame or its grill in order to open and close the frame. If the frame or grill is hot, a user would, of course, have to wait until they cool, or use a cloth if available to insulate the user from the grill or frame. However, in the arrangement of the present invention frame handle 82 by being attached directly to the frame 38 enables the user to safely grasp the handle rather than the frame when opening and closing the frame as in FIG. 9. This handle 82 improvement thus eliminates the need to wait for the fixture to cool or to use an insulating cloth in order to open or close frame 38.

Finally, as previously referred to the fixture 10 of the present invention also includes a light bulb storage area within hollow handle 72 as seen in FIG. 8. A removable sleeve 74 holding spare bulb 76 therein is insertable into the end of handle 72 as shown in FIG. 8. When a bulb breaks or cannot otherwise be repaired, the user need only remove sleeve 74 from handle 72 to obtain spare bulb 76.

While the invention has been described with reference to a specific halogen worklight fixture embodiment thereof, it will be appreciated that the invention applies to quartz worklight fixtures and that numerous variations, modifications, and embodiments are possible, and accordingly, all such variations, modifications, and embodiments are to be regarded as being within the spirit and scope of the invention.

What is claimed is:

1. A portable worklight fixture comprising:

a. a housing adapted to receive a bulb and having two spaced-apart side walls, spaced-apart top and bottom walls, and a back wall forming a housing cavity and a light emitting front opening;

b. a reflector mounted within said housing for reflecting light through said light emitting opening;

c. a support base attached to said housing;

d. a peripheral frame attached to said housing having open and closed positions relative to said housing, said frame having opposed vertical side, horizontal top and bottom surfaces, wherein when in said closed position said frame surrounds said light emitting opening, and when in said open position said frame is tilted with respect to said opening to provide a further opening through which a user can obtain access to said housing cavity for bulb replacement and other repairs;

e. a grill attached to said frame and operative to span said light emitting front opening when said frame is in said closed position; and f. a frame handle attached to a selected one of said side surfaces of said frame enabling the user by grasping said handle to safely open and close said frame relative to said housing for said bulb replacement and other repairs and formed such that the user is able to grasp said handle and transport said fixture with said support base serving as heat shield and located between said user and potentially hot grill and housing.

2. A portable work light fixture as recited in claim 1, wherein a height of said fixture is longer than a width of said fixture enabling a weight of said fixture to be located substantially close to said frame handle when being transported by holding said handle.

3. A portable worklight fixture as recited in claim 1, further comprising a top handle and a storage sleeve insertable within said top handle for storage of a bulb therein.

4. A portable worklight fixture as recited in claim 1, wherein said handle has respective first and second ends attached to said frame selected side surface and formed as a closed loop transport handle.

* * * * *